US011643767B2

(12) United States Patent
Sparks

(10) Patent No.: US 11,643,767 B2
(45) Date of Patent: May 9, 2023

(54) QUILT MARKING ASSEMBLY

(71) Applicant: Mickie Sparks, Montpelier, ID (US)

(72) Inventor: Mickie Sparks, Montpelier, ID (US)

( * ) Notice: Subject to any disclaimer, the term of this patent is extended or adjusted under 35 U.S.C. 154(b) by 0 days.

(21) Appl. No.: 17/480,495

(22) Filed: Sep. 21, 2021

(65) Prior Publication Data

US 2023/0086357 A1 Mar. 23, 2023

(51) Int. Cl.
*B43L 13/20* (2006.01)
*D05B 97/12* (2006.01)
*D05C 1/02* (2006.01)

(52) U.S. Cl.
CPC ..... *D05B 97/12* (2013.01); *B43L 13/20* (2013.01); *D05C 1/02* (2013.01)

(58) Field of Classification Search
CPC ..... D05B 97/12; B43L 13/20; D05C 1/02
See application file for complete search history.

(56) References Cited

U.S. PATENT DOCUMENTS 2,647,316 A * 8/1953 Hughes ..... A41H 31/00 33/2 R
4,608,939 A 9/1986 Lampley
5,749,149 A 5/1998 Claytor
5,791,062 A 8/1998 Walker
6,321,458 B1 11/2001 Hess
6,931,747 B2 * 8/2005 Rego ..... A41H 1/04 177/245
7,350,473 B2 4/2008 Henry
7,854,073 B1 * 12/2010 Webb ..... D05B 97/12 33/1 G
8,186,072 B1 5/2012 Nethery
8,813,381 B2 * 8/2014 Platt ..... D05B 97/12 33/12
D778,181 S 2/2017 Colleran
9,957,650 B1 * 5/2018 Roussell ..... D05B 97/00
10,190,245 B1 * 1/2019 Cutler ..... D05B 97/12
11,220,770 B2 * 1/2022 Chen ..... D06F 83/00
2012/0216734 A1 * 8/2012 Platt ..... A41H 3/01 112/475.08
2023/0018485 A1 * 1/2023 Christopherson ..... G01B 3/02

* cited by examiner

*Primary Examiner* — Yaritza Guadalupe-McCall

(57) ABSTRACT

A quilt marking assembly includes a measuring tape which has graduated indicia printed thereon to measure distance along a blanket when the measuring tape is stretched along the blanket. A plurality of pins is provided and each of the pins is insertable into a quilting frame upon which the blanket is positioned to mark a preferred location on the blanket. The pins are positionable such that the pins are evenly spaced along a distance measured by the measuring tape. A roll of yarn is dividable into a plurality of lengths of the yarn. Each of the lengths of yarn is stretchable between a respective pair of pins to define a grid on the blanket. A marker is provided to mark the blanket at each of a plurality of intersections of the grid defined by the lengths of yarn for quilting the blanket.

6 Claims, 6 Drawing Sheets

QUILT MARKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to marking devices and more particularly pertains to a new marking device for precisely marking a blanket for quilting or tying. The device includes a measuring tape for measuring distance and a plurality of pins that can be inserted into a quilting frame upon which a blanket is positioned. The device includes a roll of yarn that can be cut into a plurality of lengths that are stretched between respective pairs of the pins. The device includes a marker that can be employed to mark the blanket at each intersection point between the lengths of yarn.

(2) Description of Related Art Including Information Disclosed Under 37 CFR 1.97 and 1.98.

The prior art relates to marking devices including a sewing template that includes a pair of panels that each has a row of holes such that the holes are aligned with each other when the panels are stacked. The prior art discloses a variety of transparent quilting panels that has a grid printed thereon for facilitating a blanket to be marked for quilting. The prior art discloses a quilting template that has a plurality of holes arranged to form a grid for marking a blanket for quilting.

BRIEF SUMMARY OF THE INVENTION

An embodiment of the disclosure meets the needs presented above by generally comprising a measuring tape which has graduated indicia printed thereon to measure distance along a blanket when the measuring tape is stretched along the blanket.

A plurality of pins is provided and each of the pins is insertable into a quilting frame upon which the blanket is positioned to mark a preferred location on the blanket. The pins are positionable such that the pins are evenly spaced along a distance measured by the measuring tape. A roll of yarn is dividable into a plurality of lengths of the yarn. Each of the lengths of yarn is stretchable between a respective pair of pins to define a grid on the blanket. A marker is provided to mark the blanket at each of a plurality of intersections of the grid defined by the lengths of yarn for quilting the blanket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
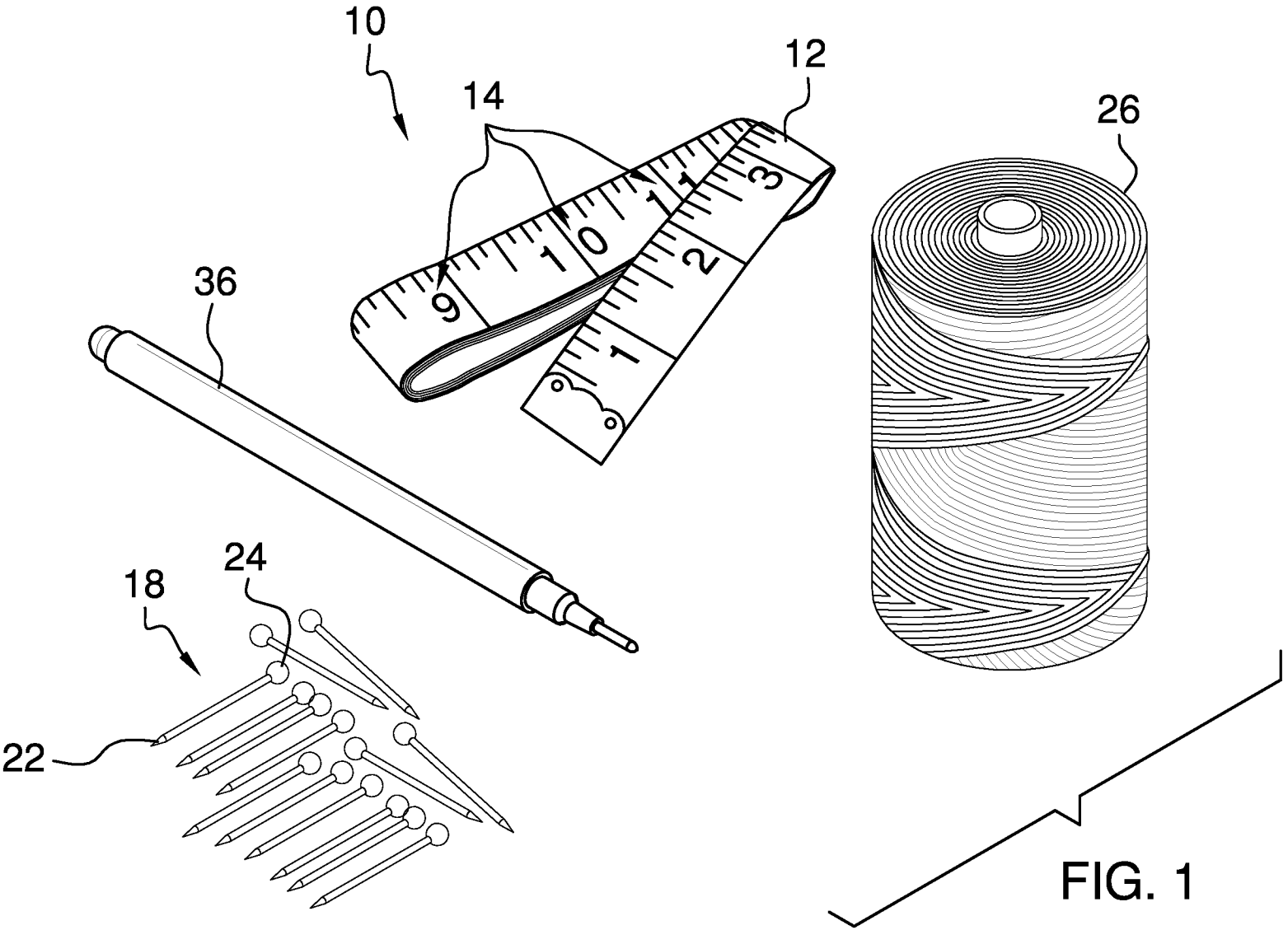
FIG. 1 is a perspective view of a quilt marking assembly according to an embodiment of the disclosure.
Figure 2:
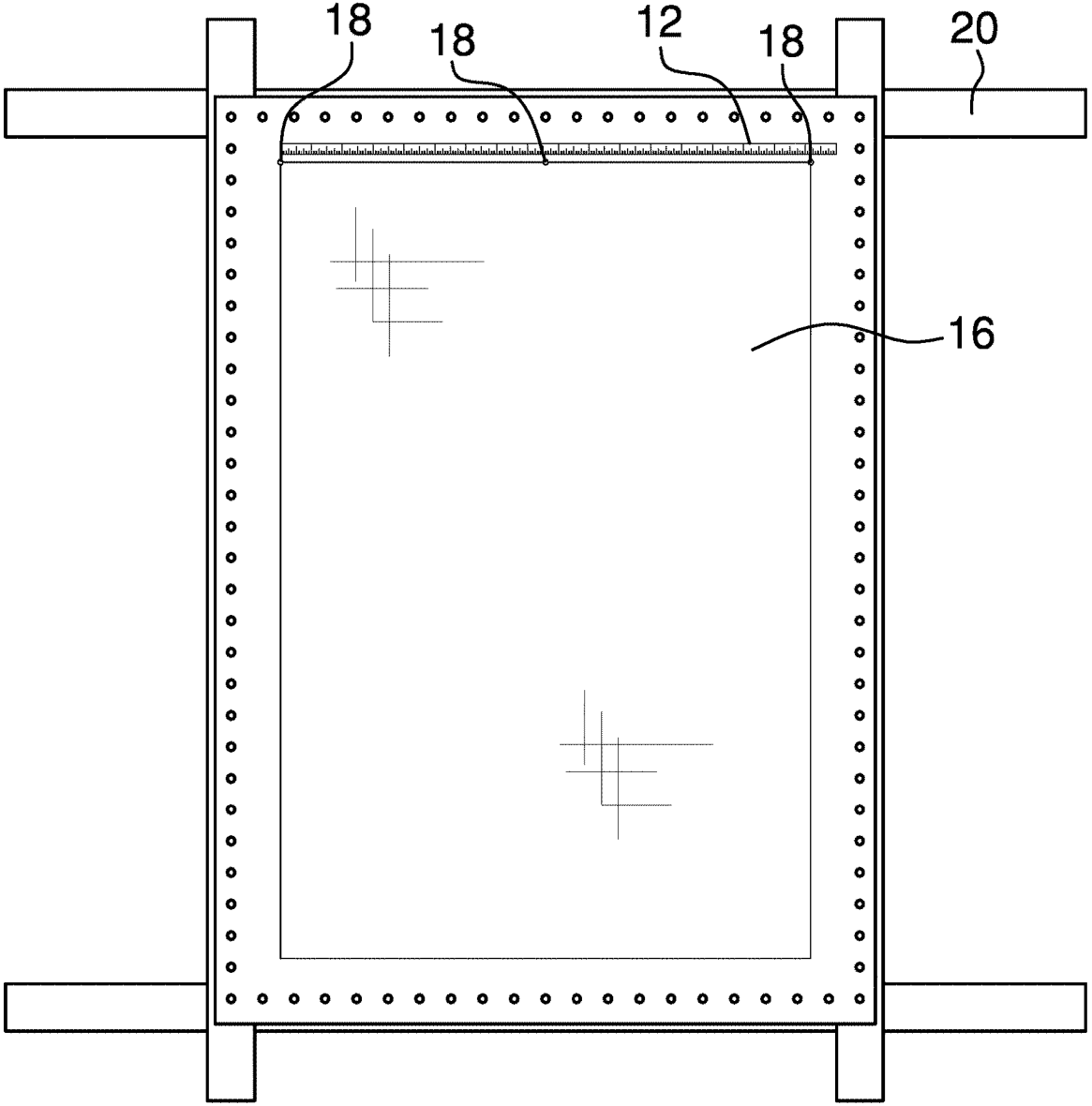
FIG. 2 is a front in-use view of an embodiment of the disclosure showing a measuring tape measuring a distance along a blanket.
Figure 3:
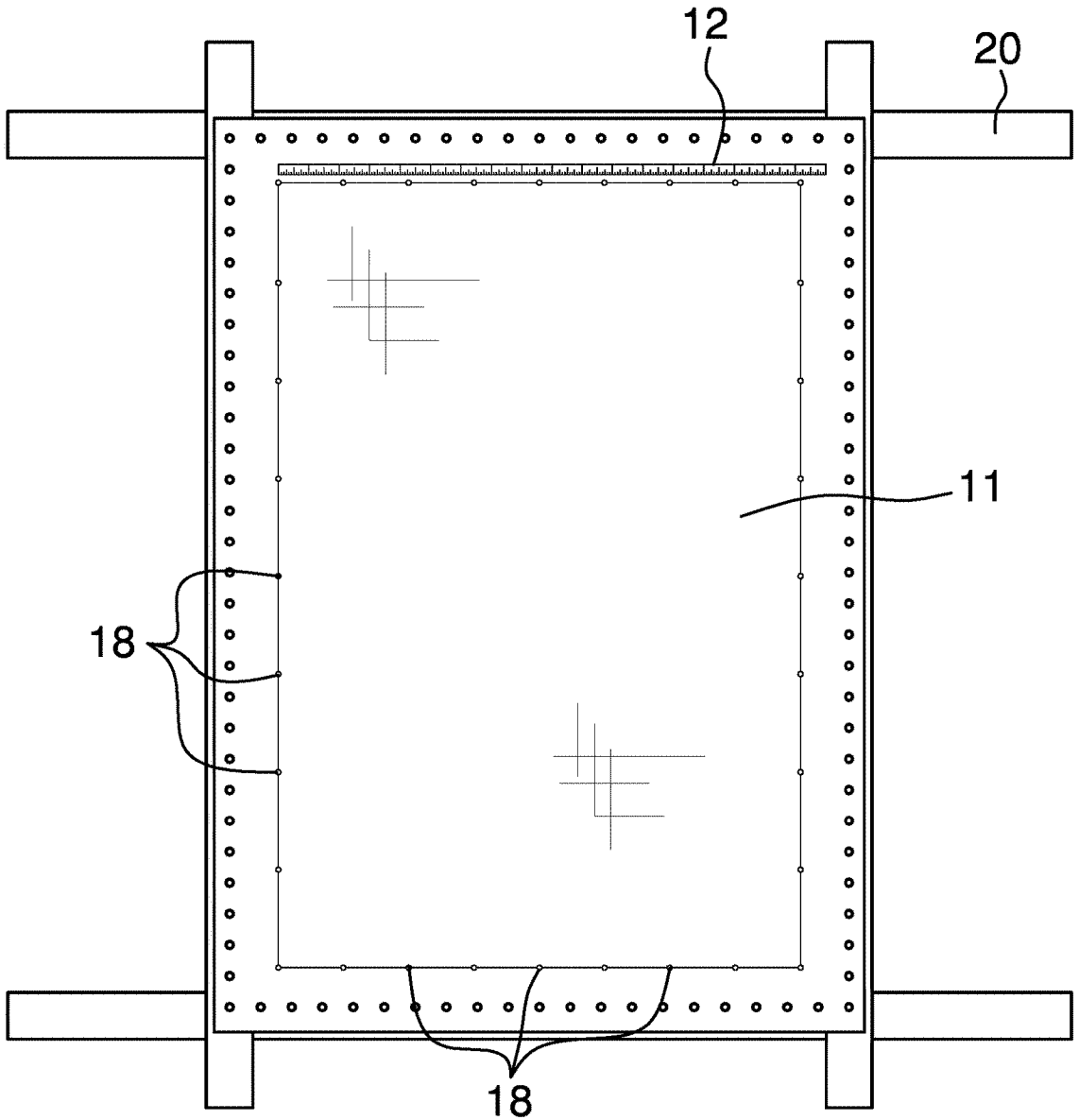
FIG. 3 is a front in-use view of an embodiment of the disclosure showing pins having been inserted into a quilting frame at predetermined locations.
Figure 4:
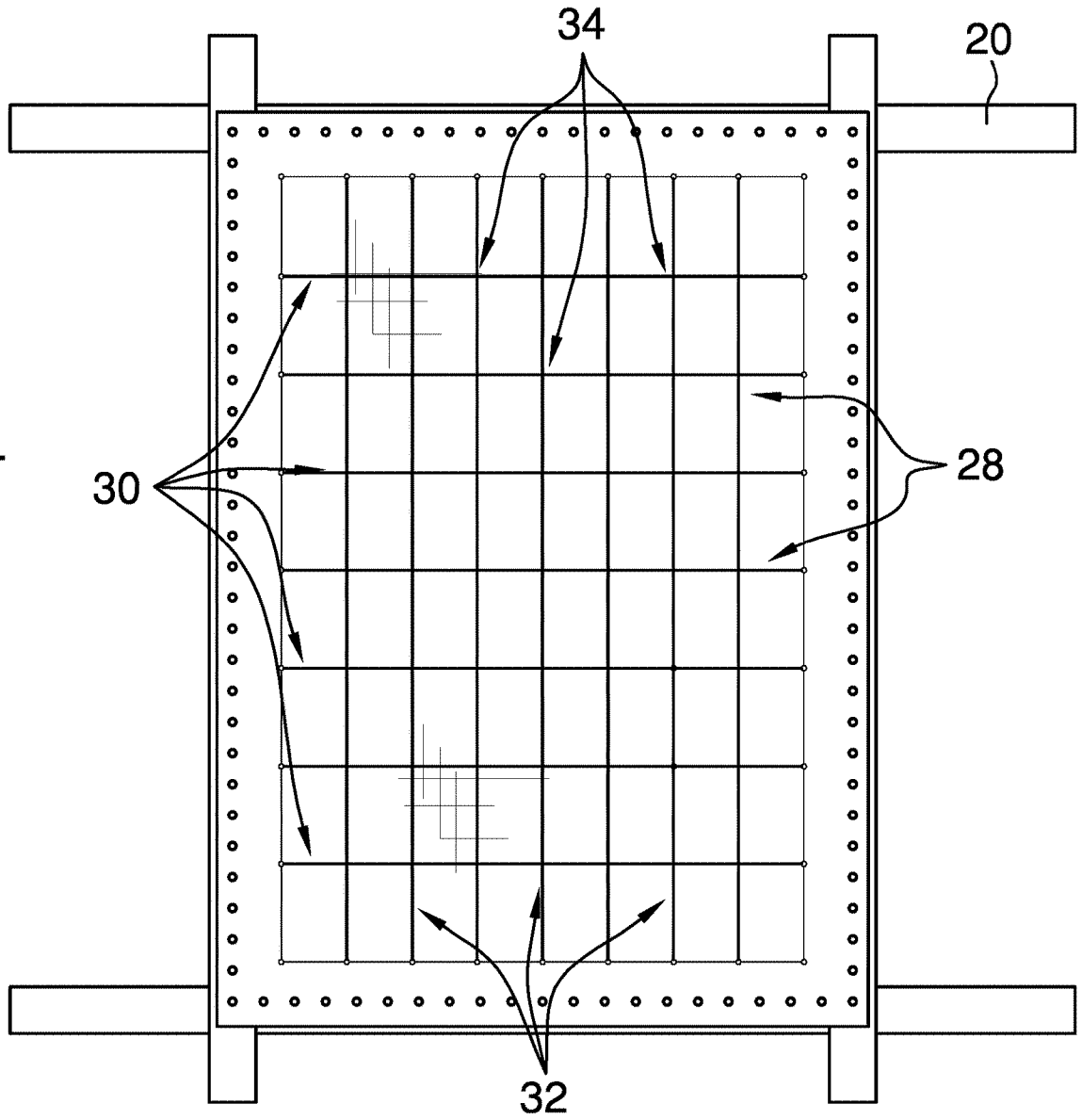
FIG. 4 is a front in-use view of an embodiment of the disclosure showing lengths of yarn being stretched between respective pairs of pins.
Figure 5:
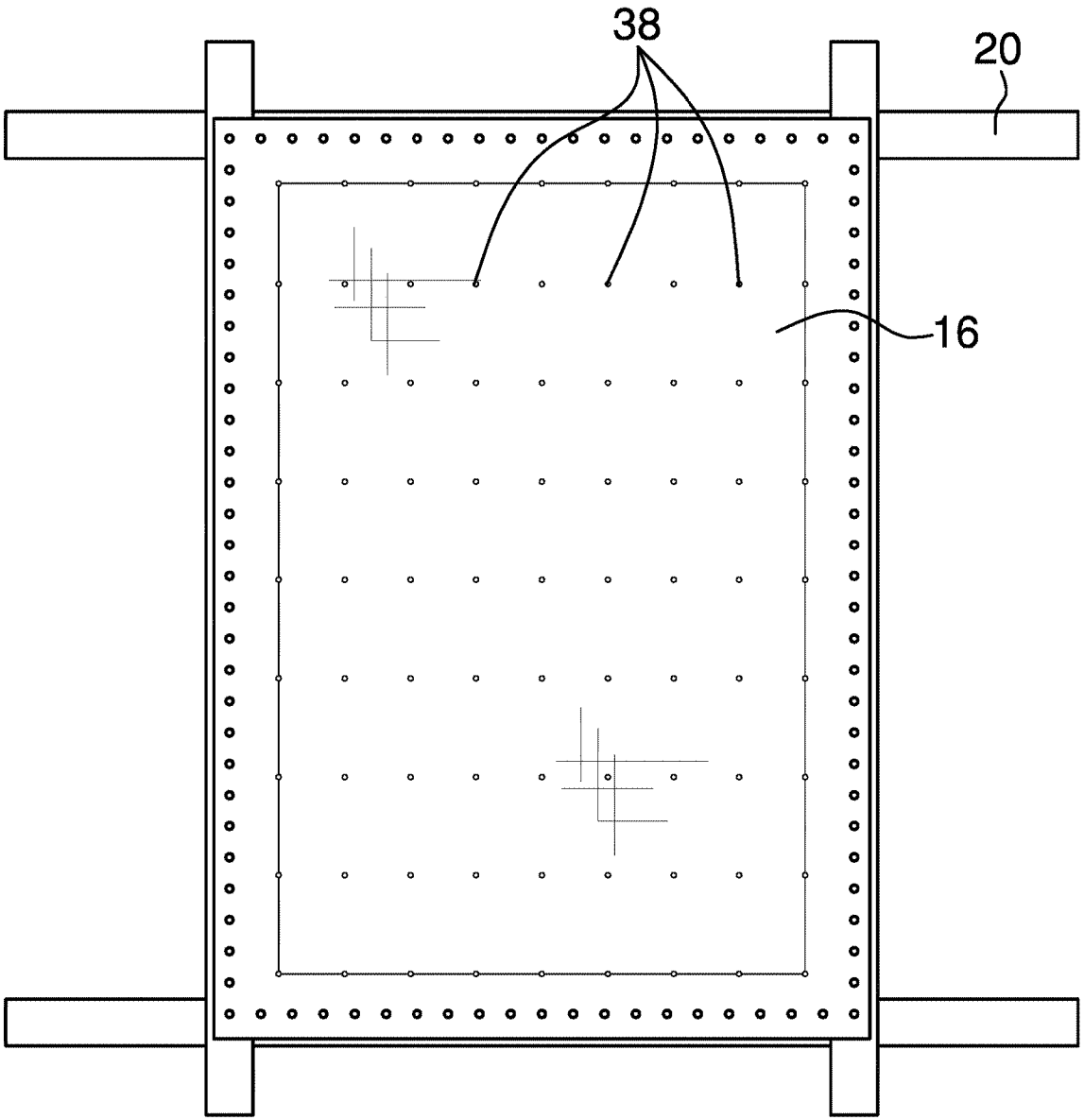
FIG. 5 is a front in-use view of an embodiment of the disclosure showing a blanket having been marked at a variety of locations for quilting.
Figure 6:
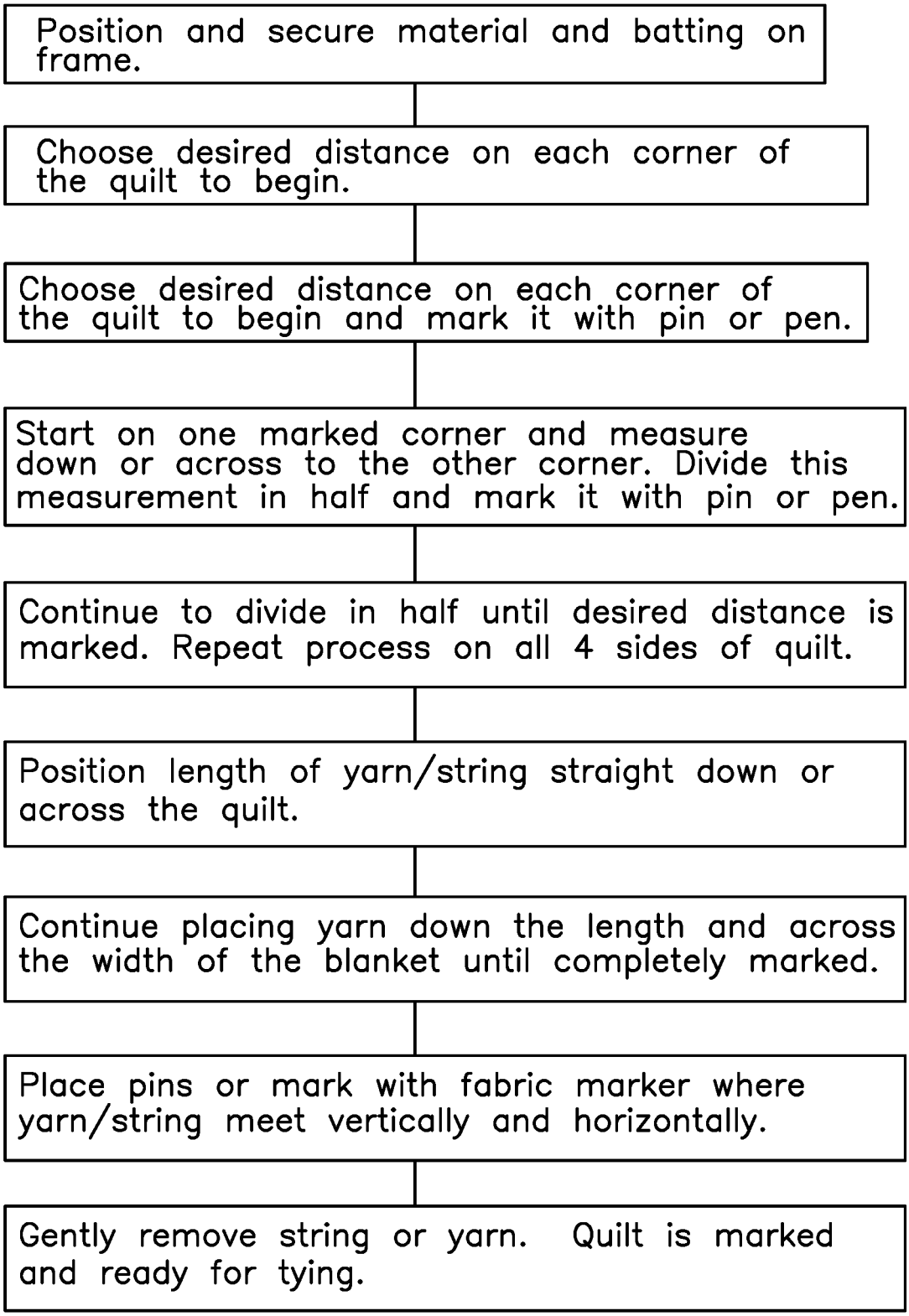
FIG. 6 is a schematic view of an embodiment of the disclosure.

With reference now to the drawings, and in particular to FIGS. 1 through 6 thereof, a new marking device embodying the principles and concepts of an embodiment of the disclosure and generally designated by the reference numeral 10 will be described.

As best illustrated in FIGS. 1 through 6, the quilt marking assembly 10 generally comprises a measuring tape 12 that has graduated indicia 14 printed thereon to measure distance along a blanket 16 when the measuring tape 12 is stretched along the blanket 16. The measuring tape 12 may be a sewing tape or other type of soft tape measure that is commonly employed in tailoring or sewing. A plurality of pins 18 is provided and each of the pins 18 is insertable into a quilting frame 20 upon which the blanket 16 is positioned to mark a preferred location on the blanket 16. The pins 18 are positionable such that the pins 18 are evenly spaced along a distance measured by the measuring tape 12 such that the plurality of pins 18 is evenly distributed around the blanket 16. The quilting frame 20 may be a quilting frame of any conventional size or design that is commonly employed for quilting or tying blankets.

Each of the pins 18 has a first end 22 and a second end 24, and the first end 22 tapers to a point. The second end 24 is rounded into a ball such that the ball can be pushed against to urge the first end 22 into the quilting frame 20. Each of the pins 18 is positionable at predetermined locations along the quilting frame 20 such that the pins 18 are spaced apart from each other and are distributed around the quilting frame 20. Furthermore, each of the pins 18 may comprise sewing pins or other similar type of stick pins.

A roll of yarn 26 is provided and the yarn 26 is dividable into a plurality of lengths 28 of the yarn 26. Each of the lengths of yarn 28 is stretchable between a respective pair of pins 18 when the plurality of pins 18 is distributed around the blanket 16. In this way each of the lengths of yarn 28 defines a grid on the blanket 16. The lengths of yarn 28 include a set of horizontal lengths 30 and a set of vertical lengths 32. Each of the horizontal lengths 30 is stretched between respective pairs of the pins 18 that are distributed on a vertical axis on the blanket 16. Conversely, each of the vertical lengths 32 is stretched between respective pairs of pins 18 that are distributed on a horizontal axis on the blanket 16. Each of the horizontal lengths 30 intersects with each of the vertical lengths 32 at a plurality of intersection points 34.

A marker 36 is provided that is filled with a liquid ink 38 to deposit the liquid ink 38 at predetermined locations on the blanket 16 for marking the blanket 16. The marker 36 is positionable to mark the blanket 16 at each of a plurality of intersections of the grid defined by the lengths of yarn 28. In this way the marker 36 can mark locations for quilting the blanket 16. The marker 36 is positionable to mark the blanket 16 at each of the intersection points 34 between the horizontal lengths 30 and the vertical lengths 32.

Additionally, the marker 36 may be a felt tip pen, a sewing marker or any other type of ink marker that can mark on textiles or fabric with a minimal amount of bleeding. Conversely, respective pins 18 can be inserted through the blanket 16 to mark the blanket 16 at each of the intersection points 34 in lieu of the marker 36.

In use, the blanket 16 is secured on the quilting frame 20 and the distance between adjacent corners of the quilting frame 20 is measured, and continually divided in half, until the plurality of pins 18 is evenly spaced apart from each other and distributed along each of the members of the quilting frame 20. The roll of yarn 26 is cut into the horizontal lengths 30 and the vertical lengths 32. Each of the horizontal lengths 30 is stretched between respective pairs of pins 18 that are distributed along a vertical axis. Each of the vertical lengths 32 is stretched between respective pairs of pins 18 that are distributed along a horizontal axis. The marker 36 is employed to mark the blanket 16 at each of the intersection points 34 between the horizontal lengths 30 and the vertical lengths 32. In this way the blanket 16 can be precisely marked for quilting or tying the blanket 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

I claim:

1. A quilt marking assembly for marking tying points on a quilt or blanket, said assembly comprising:

a measuring tape having graduated indicia being printed thereon wherein said graduated indicia is configured to measure distance along a blanket when said measuring tape is stretched along the blanket;

a plurality of pins, each of said pins being insertable into a quilting frame upon which the blanket is positioned wherein each of said pins is configured to mark a preferred location on the blanket, said pins being positionable such that said pins are evenly spaced along a distance measured by said measuring tape Wherein said plurality of pins is configured to be distributed around the blanket;

a roll of yarn, said yarn being dividable into a plurality of lengths of said yarn, each of said lengths of yarn being stretchable between a respective pair of pins when said plurality of pins is distributed around the blanket wherein each of said lengths of yarn is configured to define a grid on the blanket;

a marker being filled with a liquid ink wherein said marker is configured to deposit the liquid ink at predetermined locations on the blanket for marking the blanket, said marker being positionable to mark the blanket at each of a plurality of intersections of said grid defined by said lengths of yarn wherein said marker is configured to mark locations for quilting the blanket;

wherein each of said pins has a first end and a second end, said first end tapering to a point said second end being rounded into a ball wherein said ball is configured to be pushed against to urge said first end into the frame, each of said pins being positionable at predetermined locations along the frame such that said pins are spaced apart from each other and are distributed around the frame; and wherein said lengths of yarn includes a set of horizontal lengths, each of said horizontal lengths being stretched between respective pairs of said pins that are distributed on a vertical axis on the blanket.

2. The assembly according to claim 1, wherein said lengths of yarn includes a set of vertical lengths, each of said horizontal lengths intersecting with each of said vertical lengths at a plurality of intersection points.

3. The assembly according to claim 2, wherein said marker is positionable to mark the blanket at each of said intersection points between said horizontal lengths and said vertical lengths.

4. The assembly according to claim 1, further comprising:

said lengths of yarn including a set of horizontal lengths, each of said vertical lengths being stretched between respective pairs of pins that are distributed on a horizontal axis on the blanket, each of said horizontal lengths intersecting with each of said vertical lengths at a plurality of intersection points; and said marker being positionable to mark the blanket at each of said intersection points between said horizontal lengths and said vertical lengths.

5. A quilt marking assembly for marking tying points on a quilt or blanket, said assembly comprising:

a measuring tape having graduated indicia being printed thereon wherein said graduated indicia is configured to measure distance along a blanket when said measuring tape is stretched along the blanket;

a plurality of pins, each of said pins being insertable into a quilting frame upon which the blanket is positioned wherein each of said pins is configured to mark a preferred location on the blanket, said pins being positionable such that said pins are evenly spaced along a distance measured by said measuring tape Wherein said plurality of pins is configured to be distributed around the blanket;

a roll of yarn, said yarn being dividable into a plurality of lengths of said yarn, each of said lengths of yarn being stretchable between a respective pair of pins when said plurality of pins is distributed around the blanket wherein each of said lengths of yarn is configured to define a grid on the blanket;

a marker being filled with a liquid ink wherein said marker is configured to deposit the liquid ink at predetermined locations on the blanket for marking the blanket, said marker being positionable to mark the blanket at each of a plurality of intersections of said grid defined by said lengths of yarn wherein said marker is configured to mark locations for quilting the blanket;

wherein each of said pins has a first end and a second end, said first end tapering to a point said second end being rounded into a ball wherein said ball is configured to be pushed against to urge said first end into the frame, each of said pins being positionable at predetermined locations along the frame such that said pins are spaced apart from each other and are distributed around the frame; and wherein said lengths of yarn includes a set of vertical lengths, each of said vertical lengths being stretched between respective pairs of pins that are distributed on a horizontal axis on the blanket.

6. A method of marking a blanket for quilting, the steps of the method comprising:

providing a frame having a plurality of intersecting members such that said frame has a rectangular shape;

providing a blanket for quilting;

providing a measuring tape having graduated indicia being printed thereon for measuring distance;

providing a plurality of pins;

providing a roll of yarn;

providing a marker;

securing said blanket on said frame;

measuring the distance between adjacent corners defined by intersecting members of said frame;

continually dividing the distance between adjacent corners in half and marking the resulting location with a respective one of said pins until a plurality of the pins is evenly spaced apart from each other and distributed along a full length of said intersecting members;

cutting said roll of yarn into a plurality of vertical lengths;

stretching each of said vertical lengths between respective pairs of pins that are distributed along a horizontal axis of opposing intersecting members of said frame;

cutting said roll of yarn into a plurality of horizontal lengths;

stretching each of said horizontal lengths between respective pairs of pins that are distributed along a vertical axis of opposing intersecting members of said frame; and marking said blanket at each of a plurality of intersection points between said plurality of horizontal lengths and said plurality of vertical lengths thereby facilitating said blanket to be quilted.

* * * * *